US009877626B2

(12) United States Patent
Ebrahimi Afrouzi

(10) Patent No.: US 9,877,626 B2
(45) Date of Patent: Jan. 30, 2018

(54) HORIZONTAL AGITATOR FOR ROBOTIC VACUUM

(71) Applicant: Ali Ebrahimi Afrouzi, San Jose, CA (US)

(72) Inventor: Ali Ebrahimi Afrouzi, San Jose, CA (US)

(73) Assignee: AI Incorporated, Toronto (CA)

( * ) Notice: Subject to any disclaimer, the term of this patent is extended or adjusted under 35 U.S.C. 154(b) by 337 days.

(21) Appl. No.: 14/698,695

(22) Filed: Apr. 28, 2015

(65) Prior Publication Data

US 2015/0320279 A1 Nov. 12, 2015

Related U.S. Application Data

(60) Provisional application No. 61/990,051, filed on May 7, 2014.

(51) Int. Cl.

| | |
|---|---|
| ***B08B 5/04*** | (2006.01) |
| ***A47L 11/00*** | (2006.01) |
| ***A47L 9/04*** | (2006.01) |
| *A47L 11/19* | (2006.01) |

(52) U.S. Cl.

CPC ..... *A47L 9/0483* (2013.01); *A47L 9/0411* (2013.01); *A47L 9/0477* (2013.01); *A47L 11/19* (2013.01); *A47L 2201/00* (2013.01)

(58) Field of Classification Search

USPC ..... 134/6; 15/319

See application file for complete search history.

(56) References Cited

U.S. PATENT DOCUMENTS

| | | | | |
|---|---|---|---|---|
| 8,584,305 | B2 * | 11/2013 | Won | A47L 5/30 15/319 |
| 8,978,196 | B2 * | 3/2015 | Svendsen | A47L 5/30 15/319 |
| 2008/0052846 | A1 * | 3/2008 | Kapoor | A47L 9/106 15/52.1 |
| 2009/0049640 | A1 * | 2/2009 | Lee | A47L 9/20 15/319 |
| 2013/0061420 | A1 * | 3/2013 | Vanderstegen-Drake | A47L 9/00 15/347 |
| 2016/0302638 | A1 * | 10/2016 | Haegermarck | A47L 9/0488 |

FOREIGN PATENT DOCUMENTS

| | | | |
|---|---|---|---|
| GB | 2 028639 | * | 8/1978 |

* cited by examiner

*Primary Examiner* — Nina Bhat

(57) ABSTRACT

A horizontally vibrating brush for an automated robotic vacuum to agitate carpet fibers and like materials in a horizontal rather than vertical plane to loosen debris during vacuuming without causing debris to become more deeply embedded.

10 Claims, 2 Drawing Sheets

HORIZONTAL AGITATOR FOR ROBOTIC VACUUM

CROSS-REFERENCE TO RELATED APPLICATIONS

This application claims the benefit of provisional patent application Ser. No. 61/990,051, filed May 7, 2014 by the present inventor.

FIELD OF INVENTION

The present invention relates to automated robotic vacuums. More particularly, the present invention relates to the movement of a brush of an automated robotic vacuum.

BACKGROUND OF INVENTION

The following is a tabulation of some prior art that presently appears relevant:

U.S. Patent Documents

| Patent Number | Kind Code | Issue Date | Patentee |
|---|---|---|---|
| 2,558,496 | A | Jun. 26, 1951 | Gen Motors Corp |
| 3,813,726 | A | Jun. 4, 1974 | Cons Foods Corp |
| 7,657,967 | B2 | Feb. 9, 2010 | Lg Electronics Inc. |
| 6,148,475 | A | Nov. 21, 2000 | The Scott Fetzer Company |

Many efforts have been made to improve the effectiveness of robotic vacuum cleaners. Usually, automated robotic vacuum cleaners do not collect every debris particle in an area in a single pass. One method of dealing with this issue is having the robot cover all areas multiple times. This solution, however, requires expending more time and energy to get the job done. Additionally, this solution does not help retrieve stuck particles, but only cleans particles located freely on top of surfaces.

Other solutions involve using varied types of agitation systems to remove or loosen dirt particles from the flooring. Striking the work surface is one method of agitation, however this method can also cause some particles to become more deeply embedded in the material.

A need exists for a method for automated robotic vacuums to more thoroughly vacuum surfaces that does not lengthen the cleaning time or require significant extra energy.

SUMMARY OF THE INVENTION

It is a goal of the present invention to provide a method for an automated robotic vacuum to more thoroughly clean work surfaces without extending cleaning time or expending a significant amount of additional energy.

It is a goal of the present invention to provide a solution that does not cause debris particles to become further embedded in work surfaces.

The aforementioned goals are achieved through a horizontally vibrating brush in an automated robotic vacuum. Horizontal movements that agitate carpet or rug piles help loosen and free trapped debris without forcing the debris further downward. Horizontal movements could be added to the functionality of a robotic vacuum's main rotating brush, or could be added through a separate horizontally moving brush dedicated to that function. In systems with floor-sensing capabilities, the vibrating function can be automatically activated and deactivated as necessary based on the flooring type. The vibrating function could also be activated manually by a user. In one embodiment, a separate vibrating brush is retractable so that it can be applied when necessary and moved out of the way when not needed.

DETAILED DESCRIPTION

The present invention provides a method for improving the cleaning efficiency of automated robotic vacuums on rugs and carpets.

Figure 1A:
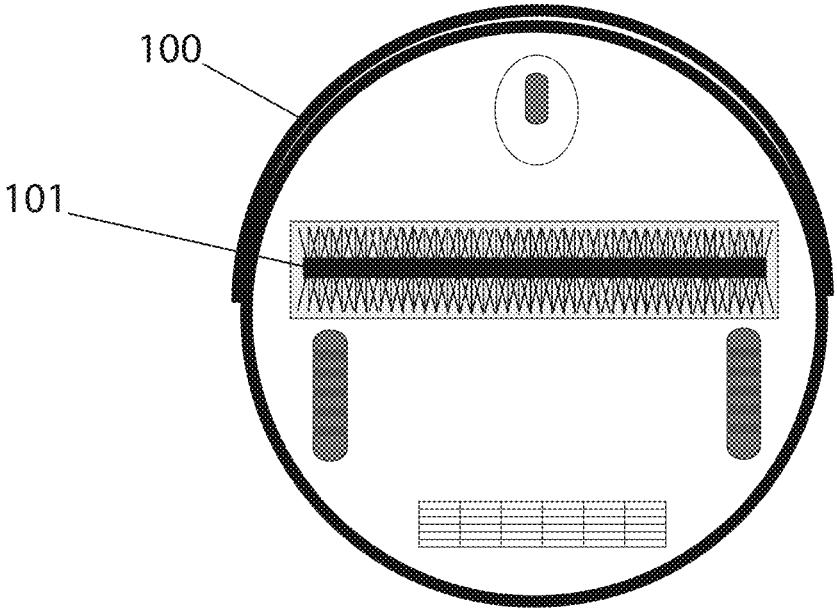
FIG. 1A shows an overhead view of the underside of an automated robotic vacuum provided with the provisioned system.
Figure 1B:
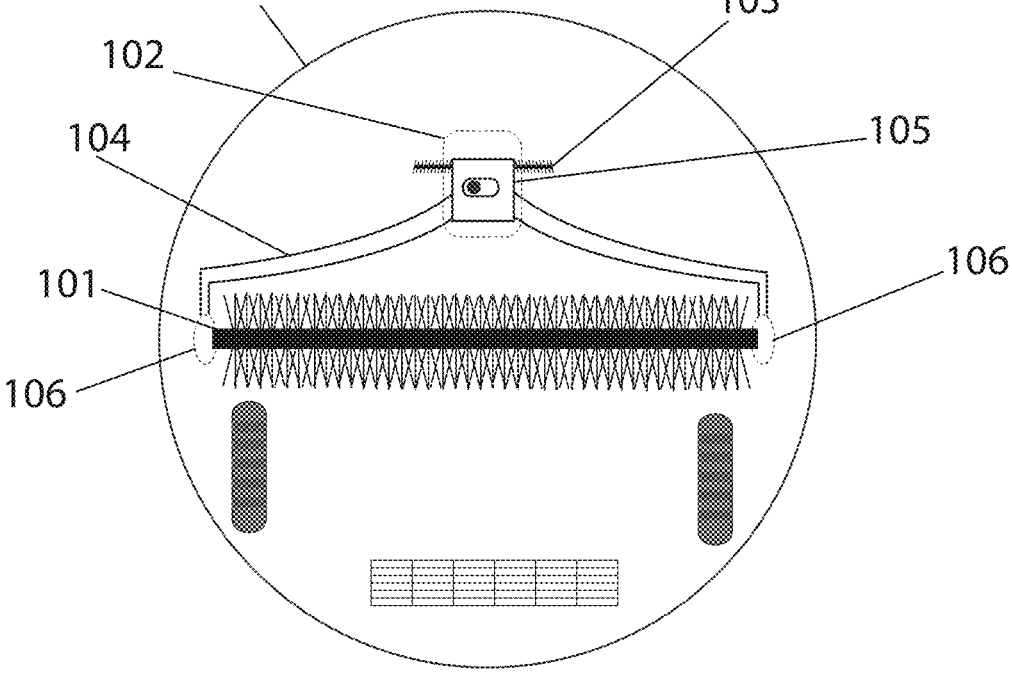
FIG. 1B shows the internal components of the provisioned vibrating brush.

FIG. 1A shows the underside of an automated robotic vacuum 100 equipped with the described system. The main brush 101 rotates to loosen and pick up debris from the floor. According to the present invention, a horizontal vibrating mechanism is added to the rotational movement of the main brush to improve the system's ability to loosen debris from fibers. FIG. 1B shows the vibrator assembly that is housed within the device 100. A vibrating electric motor 102 provides vibrations to an agitating spring 103, which connects to an agitating bar 104 through a mount 105. The agitating bar delivers the movements to the main brush 101 through rubber mounts 106. The main brush operates normally, rotating during operation, and the agitation assembly provides additional vibration functionality. Vibrations could be activated either manually when desired by the user or automatically as determined necessary by sensors. For example, a robot capable of sensing flooring types could activate the vibrations when working on carpet or rugs and deactivate the system when working on hard, non-fibrous surfaces to save energy.

Figure 2:
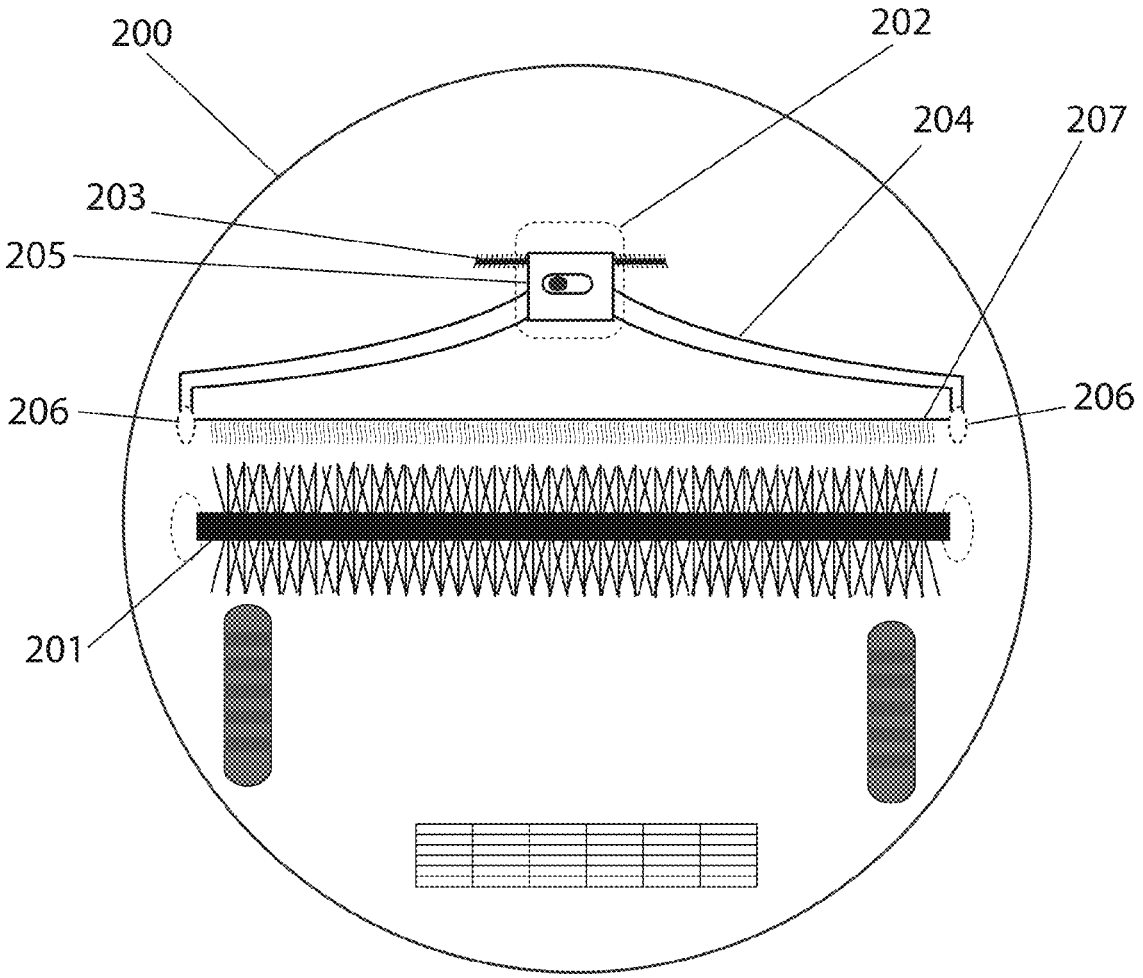
FIG. 2 shows another embodiment of the invention.

In another embodiment depicted in FIG. 2, vibrations are delivered through a separate brush 207 alongside the main brush. The cleaning robot 200 has a rotating main brush 201 and an additional vibrating brush 207 that provides vibrations in a plane horizontal to the work surface. In some embodiments, the vibrating brush 207 is vertically fixed. In some embodiments, the vibrating brush is retractable so that it can be engaged when activated and retracted when deactivated. The vibrating brush uses the same mechanism as described previously to produce vibrations. A vibrating electric motor 202 provides vibrations to an agitating spring 203, which connects to an agitating bar 204 through a mount 205. The agitating bar delivers the movements to the vibrating brush 207 through rubber mounts 206.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

I claim:

1. A method for agitating debris particles from surfaces using an automated robotic vacuum comprising:

applying power to said automated robotic vacuum;

vibrating a horizontal brush attached to said automated robotic vacuum wherein said brush vibrates in a plane horizontal to the plane of said surface powered by an electric motor;

wherein said brush vibrates by a spring connected to an agitating bar assembly connected to said automated robotic vacuum and wherein said agitating bar delivers movement to said brush through rubber mounts to agitate debris on surface and collecting said debris.

2. The method of claim 1, wherein said brush is a main brush of said automated robotic vacuum.

3. The method of claim 1, wherein said brush is a secondary brush provided separately from a main brush of said automated robotic vacuum.

4. The method of claim 1, wherein said brush is retractable such that said brush does not make contact with the surface on which said automated robotic vacuum is working.

5. The method of claim 4, wherein said automated robotic vacuum further includes a floor detection system wherein light is reflected from the floor surface by a light angled downward onto the floor from the underside of the robotic device; said light is reflected back to a light sensor located on the underside of the robotic vacuum wherein the light received by the sensor is measured and compared to a predetermined threshold light value which designates that the surface is bare floor or a carpet and based on the measured value said brush is either retracted or engaged dependent upon the detected light sensor value.

6. The method of claim 1, wherein the bristles of said brush are arranged linearly.

7. A horizontally-vibrating agitator for an automated robotic vacuum comprising:

a member projecting from the bottom of the chassis of said automated robotic vacuum into the surface on which said automated robotic vacuum is working;

wherein horizontal vibrations of said member are provided by a vibrating electric motor delivering vibrations to a spring connected to an agitating bar wherein said agitating bar delivers movement to said member through rubber mounts.

8. A horizontally-vibrating agitator for an automated robotic vacuum comprising:

a member projecting from the bottom of the chassis of said automated robotic vacuum into the surface on which said automated robotic vacuum is working;

vibrating said member in a plane horizontal to the plane on which said automated robotic vacuum is working.

9. The methods of claims 4 and 5, wherein said brush may be retracted or engaged.

10. The method of claim 1, wherein said brush may be engaged such that said brush makes contact with a surface on which said automated robotic vacuum is working.

* * * * *